US007069597B2

(12) United States Patent
Hardenbrook

(10) Patent No.: US 7,069,597 B2
(45) Date of Patent: Jul. 4, 2006

(54) HEAT ACTIVATED FORM FITTING HAIR CAP

(76) Inventor: Wendy Hardenbrook, 4748 Freshwater Rd., Delaware, OH (US) 43015

( * ) Notice: Subject to any disclaimer, the term of this patent is extended or adjusted under 35 U.S.C. 154(b) by 79 days.

(21) Appl. No.: 10/423,138

(22) Filed: Apr. 25, 2003

(65) Prior Publication Data

US 2004/0040066 A1 Mar. 4, 2004

Related U.S. Application Data

(60) Provisional application No. 60/406,245, filed on Aug. 27, 2002.

(51) Int. Cl.
*A42B 1/12* (2006.01)

(52) U.S. Cl. ..... 2/68; 2/171

(58) Field of Classification Search ..... 2/68, 2/171.03, 171, 103, 171.02, 183, 200.1
See application file for complete search history.

(56) References Cited

U.S. PATENT DOCUMENTS 3,650,267 A 3/1972 Anderson
3,933,244 A 1/1976 Hughes et al.
4,279,039 A * 7/1981 Drew ..... 2/428
5,101,512 A * 4/1992 Weinstein ..... 2/84
5,265,278 A 11/1993 Watanabe
5,850,636 A 12/1998 Reuven
6,047,706 A * 4/2000 Skiba et al. ..... 132/200
6,351,852 B1 * 3/2002 Propp ..... 2/174

FOREIGN PATENT DOCUMENTS

FR 2481585 * 4/1980

* cited by examiner

*Primary Examiner*—Gary L. Welch
(74) *Attorney, Agent, or Firm*—David J. Dawsey; Michael J. Gallagher; Gallagher & Dawsey Co., L.P.A.

(57) ABSTRACT

A heat activated form fitting hair cap to protect the hair and to retain hair products in close proximity to the hair. A loosely fitted hair cap is made from a heat activated shrink-wrap material that may be substantially moisture and gas resistant. The cap is placed over the hair, and optionally, secured with a variety of retention means such as elastic, drawstrings, or ties. Upon application of heat, normally from a hair dryer, at or slightly above the activation temperature of the plastic, the shrink-wrap material is activated and shrinks snugly about the hair. This effectuates both a protection of the hair, and a tendency to trap and retain hair treatment products that might have been applied to the hair. Options include pouches containing releasable hair treatment products on the inside of the cap and tear away areas to customize the size of the cap to the wearer.

3 Claims, 4 Drawing Sheets

HEAT ACTIVATED FORM FITTING HAIR CAP

CROSS REFERENCE TO RELATED APPLICATIONS

This application claims the benefit of U.S. Provisional Application No. 60/406,245, filed on Aug. 27, 2002, all of which is incorporated by reference as if completely written herein.

TECHNICAL FIELD

The present invention relates to the field of hair care products, in particular, to a heat activated form fitting hair cap capable, among other uses, of promoting the retention of hair care products upon the hair.

BACKGROUND OF THE INVENTION

Hair care is in excess of a $100 billion (U.S.) dollar industry. A large percentage of this total is spent on hair care products, including hair conditioners, gels, oil, and other hair treatments. Since the earliest days of such treatments, consumers have faced an ongoing problem, the need to retain these products on their hair while the treatments work on the hair. Many unsatisfactory solutions have been attempted. The simplest of these is to apply some type of cap or head covering over the treated hair. Ideally, this head covering needs to be made of some non-absorbent material in order not to absorb the hair treatment away from the hair, thus defeating the purposes of the treatment. Plastic caps, often shower caps, are the prototypical hair covering in this class, but these caps have numerous drawbacks. They are loose fitting and can be easily dislodged by wind or touch. They are bulky and unsightly. They fit loosely, and therefore do not assist in distributing the hair treatment among the hair shafts. Lastly, their loose fit promotes the pooling of hair treatment products which are likely to then run out from under the cap, damaging or putting unsightly marks on clothing.

The art has developed various means of retaining hair care products within a cap-like device. For example, U.S. Pat. No. 5,265,278 to Watanabe utilizes a loose, bouffant style cap that contains a ceramic paper liner within layers of plastic material. The ceramic paper layer is designed to retain heat. Also, U.S. Pat. No. 5,850,636 to Reuven teaches a loose, bouffant style cap that contains a gel layer held in a space between two layers of plastic.

These devices share several common shortcomings that are addressed by the instant invention. First, the caps are loose, bouffant style caps that are not form fitted to the head. As a result, they are loose when worn, and are susceptible to being disturbed by wind or touch. Secondly, as they are not form fitted to the head, they are incapable of exerting any compressive force upon the hair. As a result, they are incapable of exerting any hydraulic pressure on hair care products that may have been applied to the hair. Further, hair care products would tend to pool along the elastic band line of these caps, and would not tend to be evenly distributed around the individual hair shafts. Additionally, application of one of the prior art caps will inevitably trap air beneath it, potentially interfering with the utility of various hair care products that may have been applied underneath.

Accordingly, the art has needed a means of providing a form fitted cap that, among other utilities, retains hair products and excludes air, and that is both comfortable and easy to apply. The instant invention provides for these needs.

SUMMARY OF INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations. The instant invention demonstrates such capabilities and overcomes many of the shortcomings of prior methods in new and novel ways.

In one of the simplest configurations, the heat activated form fitting hair cap of the instant invention is utilized for substantially sealing an area of a body, such as the scalp, from the environment. The heat activated form fitting hair cap includes a heat activated shrinkable body having at least one layer of material generally sized to receive a portion of a human head. The cap is generally bounded substantially by a distal edge. Once the cap is placed on the head, the heat activated shrinkable body may be activated by exposure to a heat source, such as by way of example and not limitation, a hair dryer. Due to its material properties, the heat activated shrinkable body shrinks, thereby reducing the open interior volume, forming a tight fit around the area of the body that is to be enclosed.

The cap may also include at least one cap retention means located substantially near the distal edge for ensuring that the distal edge substantially conforms to the head prior to activation and that allows the cap to be adjusted to fit a wide range of head shapes and sizes prior to activation. The at least one cap retention means may include at least one elasticized band, at least one drawstring, or a plurality of ties. To further increase the adjustability of the cap, another embodiment may include a plurality of tear away stress lines that are substantially concentric with the distal edge, thereby imparting adjustability of the volume. In this embodiment, the user may tear away portions of the cap along any of the plurality of tear away stress lines, either before or after shrinking the cap, thereby achieving a custom fit.

One primary illustrative use for the cap is for applying hair/scalp care products to the head. As such, the material of the heat activated shrinkable body may be substantially moisture resistant and/or substantially gas impermeable to aid in the hair/scalp treatment. For example, a user may seek to infuse their hair and scalp with a conditioning treatment. The cap forces the treatment fluid deep into the hair and to the scalp while substantially isolating the treatment area from the surrounding environment.

The cap reduces the amount of heat transfer from the head to the surrounding atmosphere, thus increasing the effectiveness of the treatment. Variations of the cap may incorporate aspects to further retain the heat that is generally lost through the head, such as employing multiple layers of cap material. Such multilayer embodiments may include air spaces and/or infill material between the multiple layers to further reduce heat transfer.

The heat activated form fitting hair cap may incorporate virtually any thermally activated shrinking material. The simplest embodiments incorporate shrink films made essentially of PVC, polyolefin, polyethylene, polyester, nylon, or saran; however one with skill in the art can recognize a number of alternative materials. The activation temperature, thickness, and shrink rate of the material may be adjusted to the particular application.

Additional variations of the heat activated form fitting hair cap may further include methods of introducing treatment fluids directly from the cap, such as including at least one treatment pouch on the inside of the cap housing at least one treatment fluid. While the description herein focuses on the use of the heat activated form fitting hair cap for applying treatment to the hair/scalp, it may be equally effective in a number of other applications. Examples of such applications may include situations wherein it is desirable to keep the hair or scalp dry to reduce the chances of hypothermia, such as during swimming, watersports, or virtually any outdoor activity. Additionally, the cap may be used to protect the wearer from undesirable gripping of the hair or scalp during sporting activities such as wrestling. Further, the cap may be used as a hygienic measure to retain loose hair as may be desired in the medical professions and in the food service industry.

BRIEF DESCRIPTION OF THE DRAWINGS

Without limiting the scope of the present invention as claimed below and referring now to the drawings and figures:

DETAILED DESCRIPTION OF THE INVENTION

The heat activated form fitting hair cap of the instant invention enables a significant advance in the state of the art. The preferred embodiments of the apparatus accomplish this by new and novel arrangements of elements and methods that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention.

Figure 1:
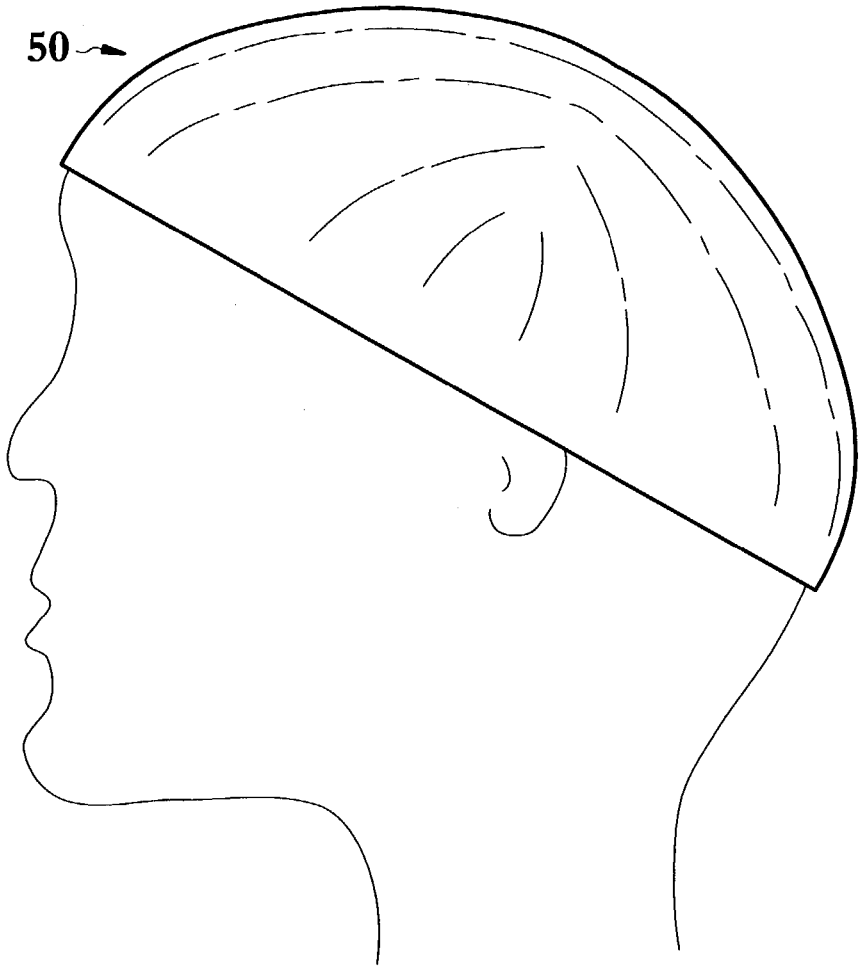
FIG. 1 shows a heat activated form fitting hair cap of the present invention, in the shrunken state, on a human head in side elevation view, not to scale.
Figure 2:
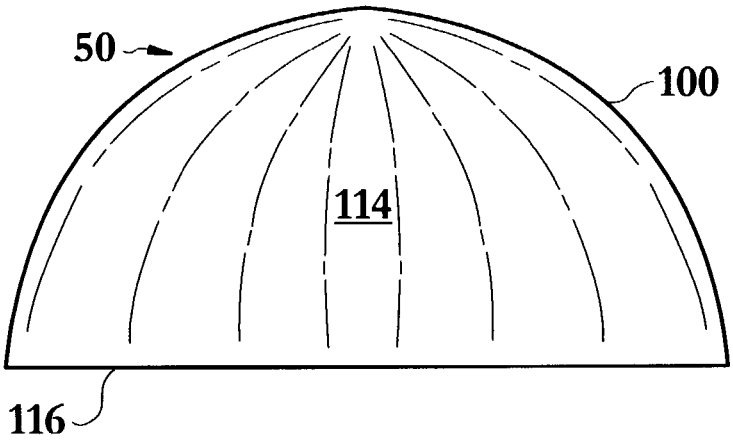
FIG. 2 shows the heat activated form fitting hair cap of FIG. 1 in front elevation view, not to scale.
Figure 3:
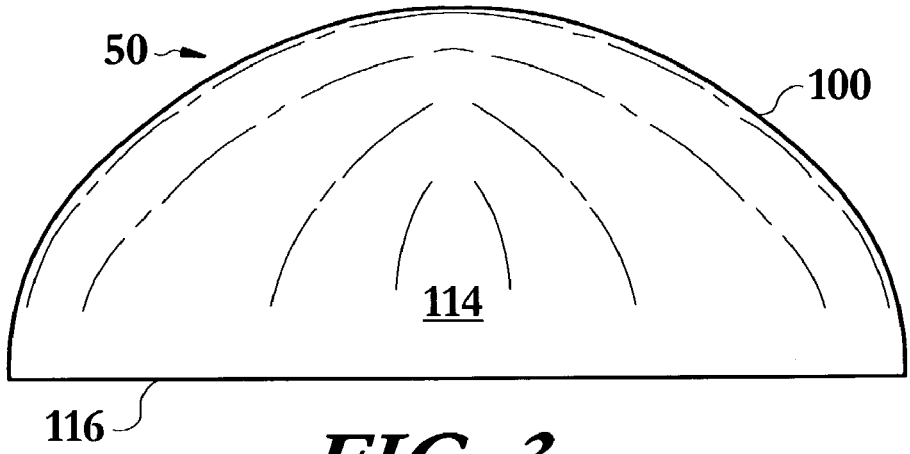
FIG. 3 shows the heat activated form fitting hair cap of FIG. 1 in side elevation view, not to scale.

In its simplest form the heat activated form fitting hair cap 50 of the instant invention is utilized for substantially sealing an area of a body, generally an area having hair, such as the scalp, from the environment. The heat activated form fitting hair cap 50 includes a heat activated shrinkable body 100 having at least one layer of material wherein the body 100 is formed to define an open interior volume that is generally sized to receive a portion of a human head, as shown in FIG. 1. Each of the at least one layer of material has a distal edge 116, an inner surface 112, and an outer surface 114, as shown in FIG. 2 and FIG. 3. The open interior volume is generally bounded substantially by the distal edge 116. Furthermore, once the cap 50 is placed on the head, the heat activated shrinkable body 100 may be activated by exposure to a heat source producing a first predetermined activation temperature on the outer surface 114 of the heat activated shrinkable body 100. Due to the material properties of the heat activated shrinkable body 100, it shrinks, thereby reducing the open interior volume, when exposed to the first predetermined activation temperature, forming a tight fit around the area of the body that is to be enclosed, as shown in FIG. 1.

Figure 4:
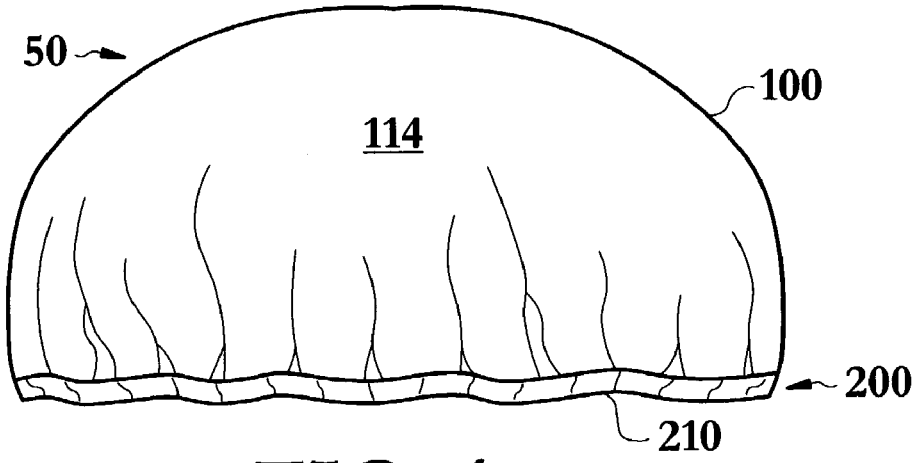
FIG. 4 shows a variation of the heat activated form fitting hair cap of FIG. 1 in side elevation view, not to scale.
Figure 5:
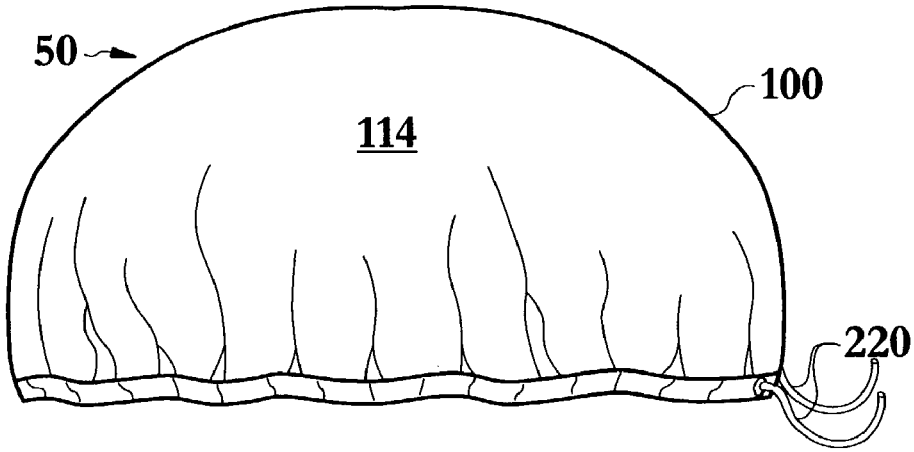
FIG. 5 shows a variation of the heat activated form fitting hair cap of FIG. 1 in side elevation view, not to scale.
Figure 7:
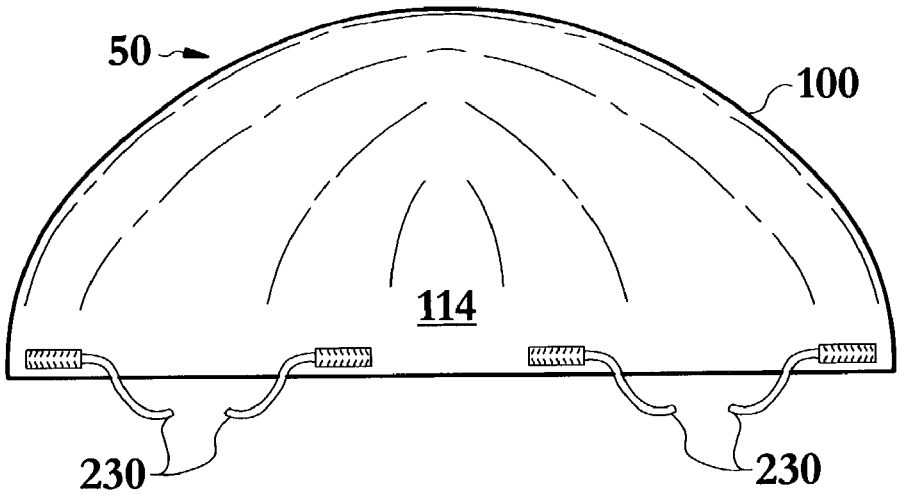
FIG. 7 shows a variation of the heat activated form fitting hair cap of FIG. 1 in side elevation view, not to scale.
Figure 8:
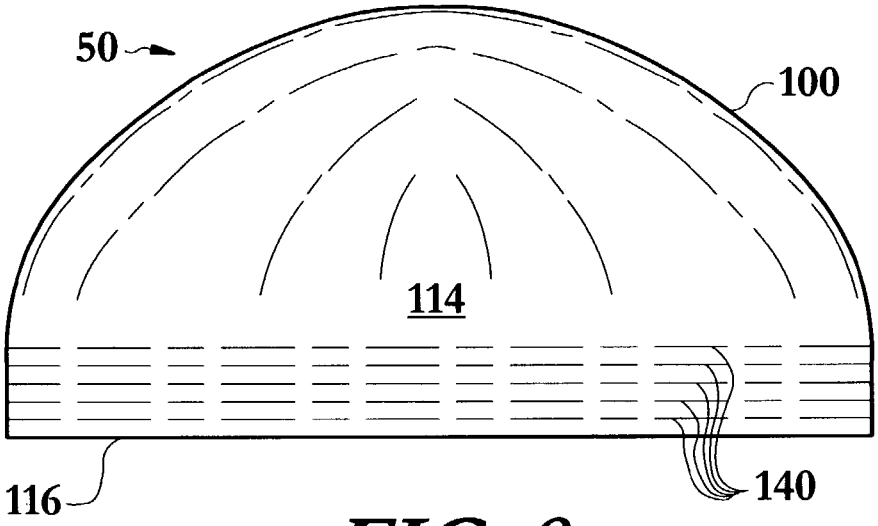
FIG. 8 shows a variation of the heat activated form fitting hair cap of FIG. 1 in side elevation view, not to scale.

The heat activated form fitting hair cap 50 may also include at least one cap retention means 200 located substantially near the distal edge 116 and thereby ensuring the distal edge 116 substantially conforms to the head prior to activation. The at least one cap retention means 200 allows the cap 50 to be adjusted to fit a wide range of head shapes and sizes prior to activation. The at least one cap retention means 200 may include a number of variations. For instance, the at least one cap retention means 200 may include at least one elasticized band 210, as seen in FIG. 4. In an alternative embodiment seen in FIG. 5, the at least one cap retention means 200 may include at least one drawstring 220. Furthermore, the at least one cap retention means 200 may include a plurality of ties 230, as illustrated in FIG. 7. To further increase the adjustability of the cap 50, another embodiment may include a plurality of tear away stress lines 140, in the at least one layer of material, that are substantially concentric with the distal edge 116 thereby imparting adjustability of the volume, as seen in FIG. 8. In this embodiment, the user may tear away portions of the cap 50 along any of the plurality of tear away stress lines 140, either before or after shrinking the cap 50 to conform to the head, thereby achieving a custom fit.

While the heat activated form fitting hair cap 50 of the instant invention has a number of uses, one primary illustrative use is for applying hair/scalp care products to the head. As such, the material of the heat activated shrinkable body 100 may be substantially moisture resistant and/or substantially gas impermeable to aide in the hair/scalp treatment. For example, in just one application, a user may seek to infuse the hair and scalp with a conditioning treatment. As such, the hair would generally be wetted and the conditioning treatment applied. Traditionally, a towel may be wrapped around the head in an effort to prevent the treatment from running out of the hair and into the user's eyes, or into other undesirable areas. Furthermore, since the hair and treatment is essentially exposed to the surrounding atmosphere it often quickly dries, thereby reducing the effectiveness of the treatment. It is widely known that creating a barrier between the treatment area and the surrounding environment increases the effectiveness of the treatment. The cap 50 of the instant invention forces the treatment fluid deep into the hair and to the scalp while substantially isolating the treatment area from the surrounding environment. Embodiments that include moisture barriers and gas barriers greatly slow the evaporation of the hair's moisture as well as the treatment fluid.

Figure 9:
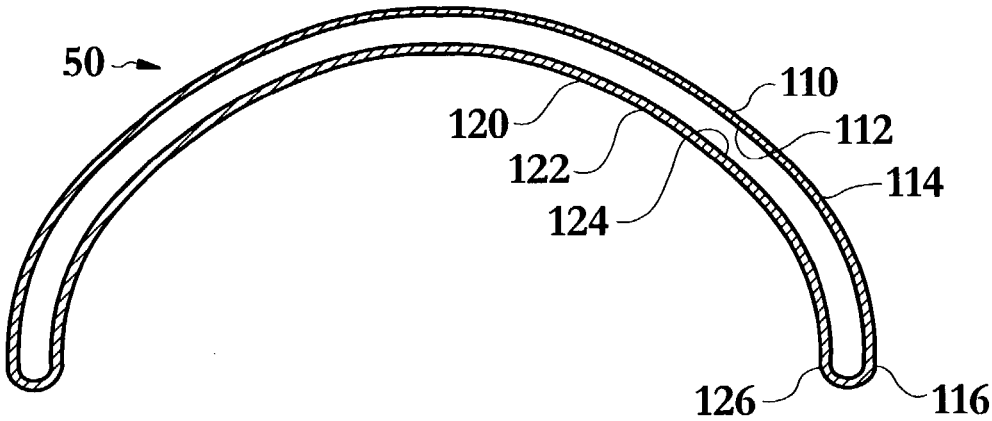
FIG. 9 shows a variation of the heat activated form fitting hair cap of FIG. 1 in cross sectional view, not to scale.

Furthermore, the cap 50 reduces the amount of heat transfer from the head to the surrounding atmosphere. This increased temperature in the treatment area further increases the effectiveness of the treatment. Variations of the cap 50 may incorporate aspects to further retain the heat that is generally lost through the head. For instance, the cap 50 may incorporate multiple layers of material. The embodiment illustrated in FIG. 9 shows a cap 50 wherein the at least one layer of material includes a first layer 110 and a second layer 120 joined at least in part along the distal edge 116 of each layer. One with skill in the art will appreciate that the multiple layers may be joined in any number of ways and at any number of locations. Such multilayer embodiments may include air spaces and/or infill material between the multiple layers to further reduce heat transfer.

The heat activated form fitting hair cap 50 may incorporate virtually any thermally activated shrinking material. The simplest embodiments incorporate shrink films made essentially of PVC, polyolefin, polyethylene, polyester, nylon, or saran; however one with skill in the art can recognize a number of alternative materials. In some embodiments, those directed toward home (non-professional) use, the materials of construction are selected such that the first predetermined activation temperature can be applied with a conventional hair dryer. As such, in this embodiment, the first predetermined activation temperature is between approximately 100 degrees Fahrenheit and 140 degrees Fahrenheit. Further, the material thickness of the heat activated shrinkable body 100 may vary greatly depending on the particular application. However, in the home (non-professional) use embodiments, the material thickness is between approximately 0.25 mil and approximately 8 mil. Additionally, the shrinkage rate of the heat activated form fitting hair cap 50 is dependent upon the material and the material thickness. The shrinkage rate for most home (non-professional) embodiments of the heat activated form fitting cap is between approximately 20 percent and approximately 85 percent. This range allows the creation of a cap 50 that may be effectively applied to a wide range of head sizes.

Figure 6:
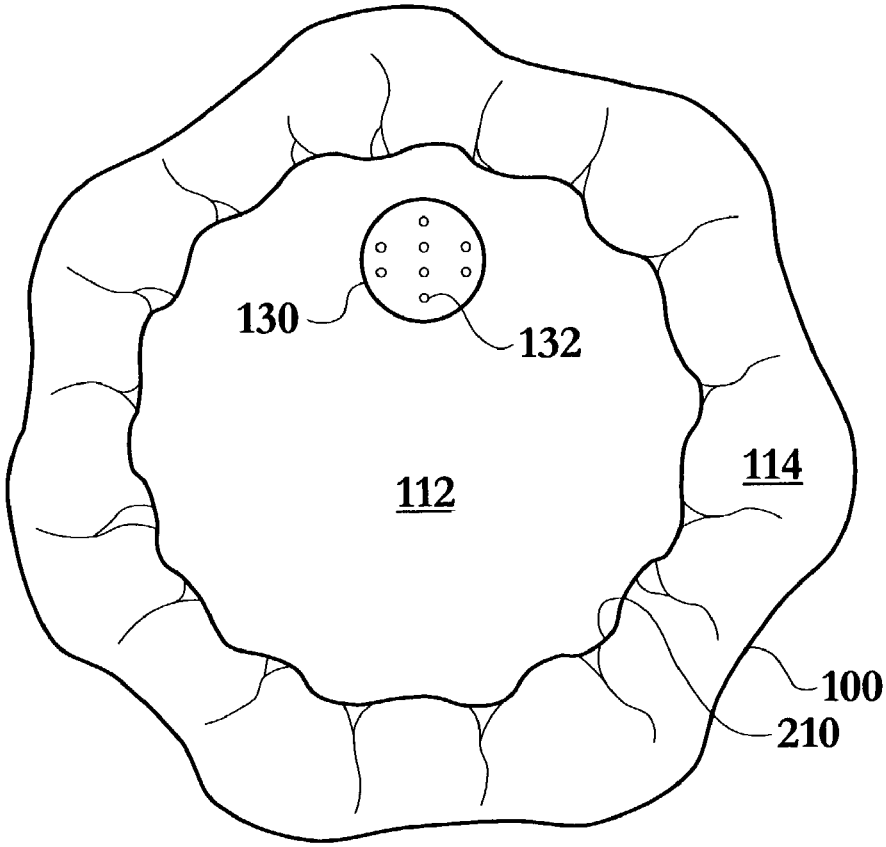
FIG. 6 shows a variation of the heat activated form fitting hair cap of FIG. 1 in bottom plan view, not to scale.

Additional variations of the heat activated form fitting hair cap 50 may further include methods of introducing treatment fluids directly from the cap 50. One such variation, seen in FIG. 6, may include at least one treatment pouch 130 housing at least one treatment fluid. The at least one treatment pouch 130 may be constructed of the same heat activated shrinkable material as the body 100. Further, the at least one treatment pouch 130 may include at least one egress point 132 that allows the discharge of the at least one treatment fluid when exposed to a predetermined pressure. Such predetermined pressure may be created by the shrinkage of the at least one treatment pouch 130, by exertion of external forces, or by expansion of the at least one treatment fluid. In a further variation, the at least one treatment pouch 130 may be formed of a material having a second predetermined activation temperature that is different from the first predetermined activation temperature thereby permitting release of the at least one treatment fluid prior to reaching the first predetermined activation temperature, or retarding the release until after the first predetermined activation temperature has been exceeded.

While the description herein focuses on the use of the heat activated form fitting hair cap 50 for applying treatment to the hair/scalp, it may be equally effective in a number of other applications. Examples of such applications may include situations wherein it is desirable to keep the hair or scalp dry to reduce the chances of hypothermia, such as during swimming, water sports, or virtually any outdoor activity. Additionally, the cap may be used to protect the wearer from undesirable gripping of the hair or scalp during sporting activities such as wrestling. Further, the cap may be used as a hygienic measure to retain loose hair as may be desired in the medical professions and in the food service industry.

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims.

The corresponding structures, materials, acts, and equivalents of all means or step plus function elements in the claims below are intended to include any structure, material, or acts for performing the functions in combination with other claimed elements as specifically claimed.

I claim:

1. A heat activated form fitting hair cap for substantially sealing an area of a body having hair from the environment, comprising:

a heat activated shrinkable body having at least one layer of material having a thickness of between approximately 0.25 mil and approximately 8 mil, a distal edge, an inner surface, and an outer surface;

the heat activated shrinkable body formed to define an open interior volume bounded by the distal edge and generally sized to receive a portion of a human head and to shrink to conform to the shape of the head when activated by exposure to a heat source thereby creating a substantially liquid-tight seal between the distal edge and the body substantially sealing the portion of the body within the interior volume from the environment;

the heat source producing a first predetermined activation temperature between approximately 100 degrees Fahrenheit and 140 degrees Fahrenheit on the outer surface of the heat activated shrinkable body;

at least one cap retention means located substantially near the distal edge and thereby ensuring the distal edge substantially conforms to the head prior to activation;

wherein the material of the heat activated shrinkable body is substantially moisture resistant and substantially gas impermeable; and the material of the heat activated shrinkable body further having a shrinkage rate between approximately 20 percent and approximately 85 percent.

2. The heat activated form fitting hair cap of claim 1, wherein the material of the heat activated shrinkable body is chosen from the group consisting essentially of films consisting of PVC, polyolefin, polyethylene, polyester, nylon, and saran.

3. A heat activated form fitting hair cap for substantially sealing an area of a body having hair from the environment, comprising:

a heat activated shrinkable body having at least one layer of material having a thickness of between approximately 0.25 mil and approximately 8 mil, a distal edge, an inner surface, and an outer surface;

the heat activated shrinkable body wherein the material of the heat activated shrinkable body is chosen from the group consisting essentially of films consisting of PVC, polyolefin, polyethylene, polyester, nylon, and saran;

formed to define an open interior volume bounded by the distal edge and generally sized to receive a portion of a human head and to shrink to conform to the shape of the head when activated by exposure to a heat source thereby creating a substantially liquid-tight seal between the distal edge and the body substantially sealing the portion of the body within the interior volume from, the environment;

the heat source producing a first predetermined activation temperature between approximately 100 degrees Fahrenheit and 140 degrees Fahrenheit on the outer surface of the heat activated shrinkable body;

at least one cap retention means located substantially near the distal edge and thereby ensuring the distal edge substantially conforms to the head prior to activation;

wherein the material of the heat activated shrinkable body is substantially moisture resistant and substantially gas impermeable; and the material of the heat activated shrinkable body further having a shrinkage rate between approximately 20 percent and approximately 85 percent.

* * * * *